United States Patent [19]

Vanelli Coralli et al.

[11] 3,981,168

[45] Sept. 21, 1976

[54] PROTECTED CYLINDER LOCK

[75] Inventors: Giorgio Vanelli Coralli; Alessandro Brunelli, both of Bologna, Italy

[73] Assignee: Viro Innocenti S.p.A., Zola Predosa, Italy

[22] Filed: Aug. 18, 1975

[21] Appl. No.: 605,681

[30] Foreign Application Priority Data

Sept. 10, 1974 Italy ..... 12958/74

[52] U.S. Cl. ..... 70/417; 70/370

[51] Int. Cl.[2] ..... E05B 15/16

[58] Field of Search ..... 70/417, 370, 451, 418, 70/416

[56] References Cited

UNITED STATES PATENTS

| | | | |
|---|---|---|---|
| 1,408,477 | 3/1922 | Schonwald | 70/370 |
| 1,548,131 | 8/1925 | Frejesinger | 70/417 |
| 3,261,186 | 7/1966 | Laviana | 70/417 X |
| 3,899,907 | 8/1975 | Prahl | 70/370 |

*Primary Examiner*—Robert L. Wolfe

*Attorney, Agent, or Firm*—Pollock, Vande Sande & Priddy

[57] ABSTRACT

A cylinder lock mechanism of conventional type, comprising a fixed outer cylinder and an inner rotatable plug, to be mounted on a door frame, is protected by a hollow cylindrical steel casing which is fitted onto the outer cylinder of said lock mechanism. The cylindrical casing is partially closed in correspondence of the end of the cylinder lock mechanism presenting the keyhole for the insertion of the key, while it is open at the other end, which is the end directed towards the inside of the door. The outer cylinder of the cylindee lock mechanism and the protective casing are secured to the door frame independently from each other, and the outer cylinder can, if desired, rotate within the cavity of the protective casing. An additional protective disc provided with a slot for the insertion of the key into the keyhole is inserted between the front end of the cylinder lock mechanism and the internal side of the partially closed end of the casing.

9 Claims, 5 Drawing Figures

PROTECTED CYLINDER LOCK

SUMMARY OF THE INVENTION

The present invention relates to a protected cylinder lock, i.e., to a cylinder lock which is provided with special protection against burglars and thieves.

According to the invention, the cylinder lock, which is of the conventional type comprising an outer fixed cylinder and an inner rotatable plug, is protected by the provision of an armor in the form of a cylindrical casing, made of steel or other suitable material, which is fitted onto the outer cylinder so as to protect its outer or front end, i.e., the end of the cylinder which is normally exposed at the external side of the door to which the cylinder lock is applied, and its side surface. The outer cylinder of the cylinder lock mechanism and the protective casing are secured to the door frame independently from each other, so that even if the thief or burglar succeeds in causing the rotation of the outer casing, the cylinder lock mechanism enclosed thereinto will not rotate, and the bolt will consequently not be displaced.

Another method of breaking a cylinder lock, used by burglars or thieves, is that of drilling a bore, by using a suitable portable drilling tool, into the cylinder lock mechanism, in correspondence of the zone where the pin tumblers are located, thus destroying the said pin tumblers and practically freeing the rotatable plug. It will be appreciated that, by adopting the protected cylinder lock according to the invention, this type of breaking is avoided, since the drilling tool will not be able to perforate the steel casing, or it will slip against its hard smooth cylindrical surface. It is to be noted that, in order to confer a more complete protection to the cylinder lock mechanism in correspondence of the pin tumblers, an additional armored plate, in the form of a small disc provided with a slot for the insertion of the key into the keyhole, can be provided to cover the keyhole zone of the cylinder lock, which is precisely the zone from which there could be easy access to the location of the pin tumbler by the drilling tool.

The above and other characteristic features of the invention, as well as the advantages deriving therefrom, will appear evident from the following description of a preferred embodiment of same, made with reference to the accompanying drawings.

DESCRIPTION OF THE PREFERRED EMBODIMENT

Figure 1:
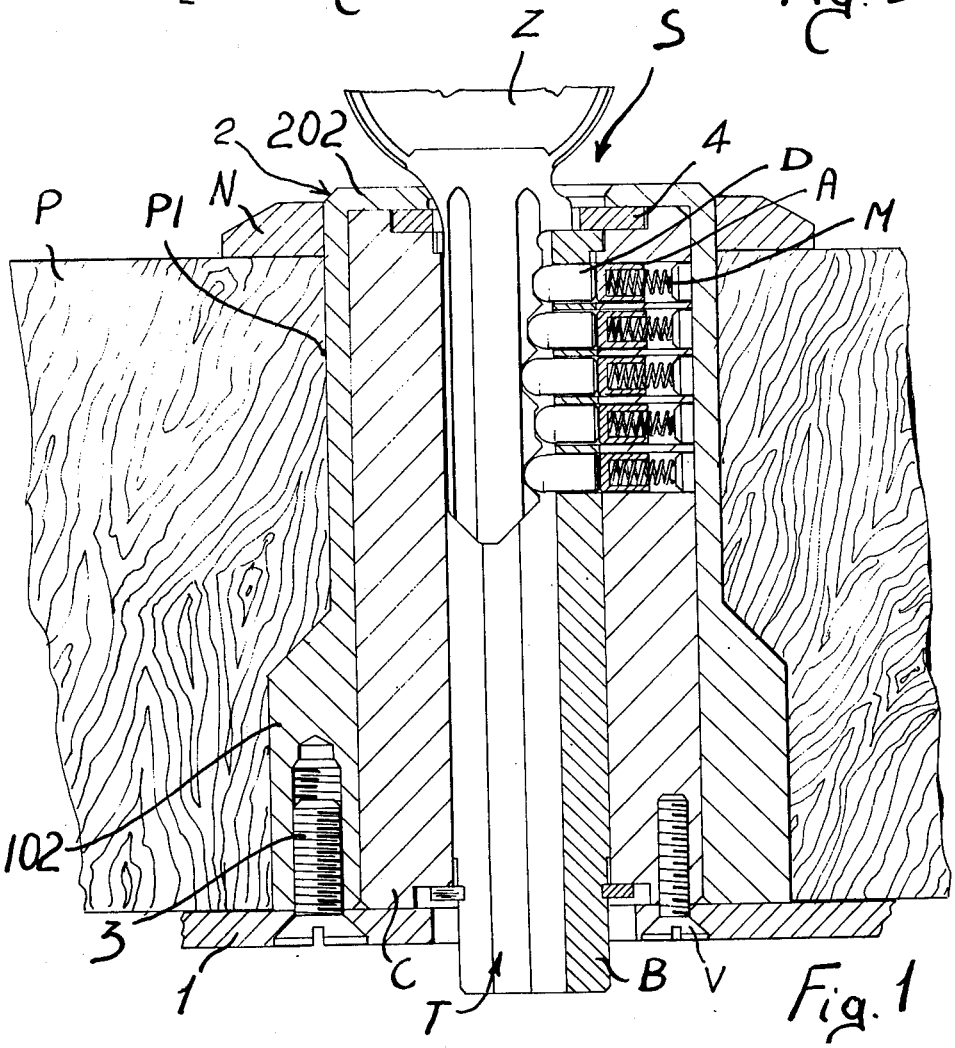
FIG. 1 is a longitudinal section, with parts in view, of a protected cylinder lock according to the invention, as applied to a door frame.

Referring to FIG. 1, there is illustrated a preferred embodiment of the protected cylinder lock according to the invention. The cylinder lock S consists of a conventional outer cylinder C which houses a rotatable inner cylinder or plug B. The rotation of plug B inside cylinder C, and consequent operation of the lock mechanism and associated bolt, can be performed only when the correct key Z has been inserted in the keyhole T, thus raising the plug pins D to the correct level against the action of the cylinder pins A urged in locking position by the springs M. The cylinder lock S is used, in the embodiment shown in FIG. 1, for locking door P, which is made of wood, and presents on its inner side a plate 1, which either is part of the bolt mechanism associated with the lock, or constitutes a reinforcing plate, and is usually made of steel or other suitable material. The lock S is mounted in a suitable bore P1 provided in the door, by securing cylinder C to said inner plate 1 by means of suitable fasteners, such as screws V. According to the invention, the outer cylinder C of the lock S is encased within a casing 2 made of steel or other suitable hard material. The casing 2 is constructed as a hollow cylinder, the inner diameter of which is substantially equal to the outer diameter of the cylinder C of the lock. Casing 2 is open at its rear end located in correspondence with the inner side of the door, i.e., the side which is not to be protected, and presents, in correspondence of said end, an enlarged portion 102 which permits the fastening of casing 2 to plate 1 by means of suitable screws 3.

It is to be noted that the through bore P1 in the door P presents, in correspondence with the inner side of the door, a flared out portion, for accommodating the enlarged portion 102 of casing 2.

Figure 2:
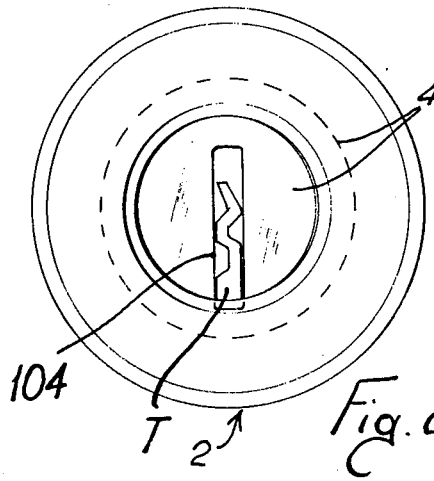
FIG. 2 is a front view of the cylinder lock according to the invention.
Figure 3:
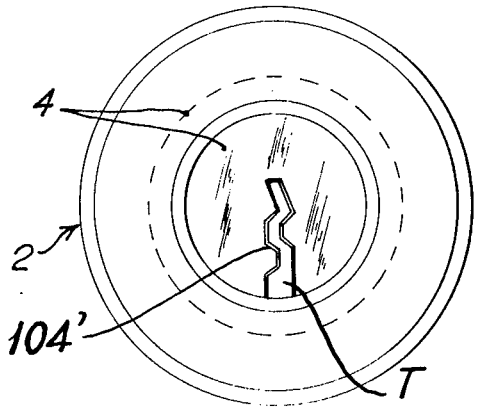
FIG. 3 is a front view similar to that of FIG. 2, showing a modified embodiment.

At its front end, i.e., the end which is located at the outer or front side of the door, cylindrical casing 2 presents a partially closed base 202, having a round bore permitting the rotation of the key Z inserted in plug B (see also FIGS. 2 and 3). In order to protect the front portion of the cylinder lock mechanism, which could be accessible through the mentioned round bore in the base 202 of the casing 2, a suitable disc-shaped element 4, made of steel or of any other suitable hard material, is inserted in a correspondingly shaped recessed portion in the front end of the cylinder lock mechanism between the said cylinder lock mechanism and the inner side of the said closed base 202. Disc element 4 has a diameter which is greater than the diameter of the round bore provided in base 202, and said disc element 4 is provided with a slot for the insertion of the key into the plug. According to FIG. 2, slot 104 has a rectangular shape, while in FIG. 3 slot 104′ presents a profile which exactly corresponds to the profile of keyhole T.

The safety afforded by the protected cylinder lock according to the invention is evident.

In the first instance, one of the most common methods of breaking or forcing a cylinder lock is that of gripping, by means of suitable gripping tools, the front end of the cylinder C and then twisting it, so as to cause the shearing of the heads of the screws V which secure the said cylinder to the plate 1, and the rotation of the cylinder together with the plug B locked inside it, with consequent possibility of displacement of the door bolt. It is to be noted that usually the outer front plates which surround the front portion in view of the lock mechanism, such as the front plate N illustrated in FIG. 1, are provided merely for aesthetic purposes, and can be ripped off very easily.

By adopting the protected lock according to the invention it appears that, even if the thief succeeds in gripping the outer casing 2 and in twisting it so as to cause the shearing of the heads of screws 3, the cylinder C, housed inside said casing 2, will not rotate since its outer cylindrical surface is not entrained into rotation by the correspondingly shaped inner surface of casing 2, bearing in mind that cylinder C is also secured to plate 1 by means of screws V. On the other hand, it is impossible to pull out the casing 1, due to the presence of its enlarged rear end portion 102.

Another very common way of breaking or forcing a cylinder lock is that of drilling a bore, by means of any suitable drilling tool, through the portion of the cylinder lock mechanism incorporating the tumbler pins and the springs (D, A, M), thus practically destroying the lock mechanism and enabling the subsequent rotation of the plug with little effort. This is possible due to the fact that usually the outer cylinder and the plug of the cylinder lock are made of comparatively soft metal, such as brass, which can be bored easily enough by using a portable drilling tool. With the protected cylinder lock according to the invention this is not possible, since the steel armor afforded by casing 2 and disc 4 cannot be penetrated by such drilling tools. It is to be noted that the drilling tool, if directed against the side cylindrical smooth surface of casing 2, will also tend to slip.

Figure 4:
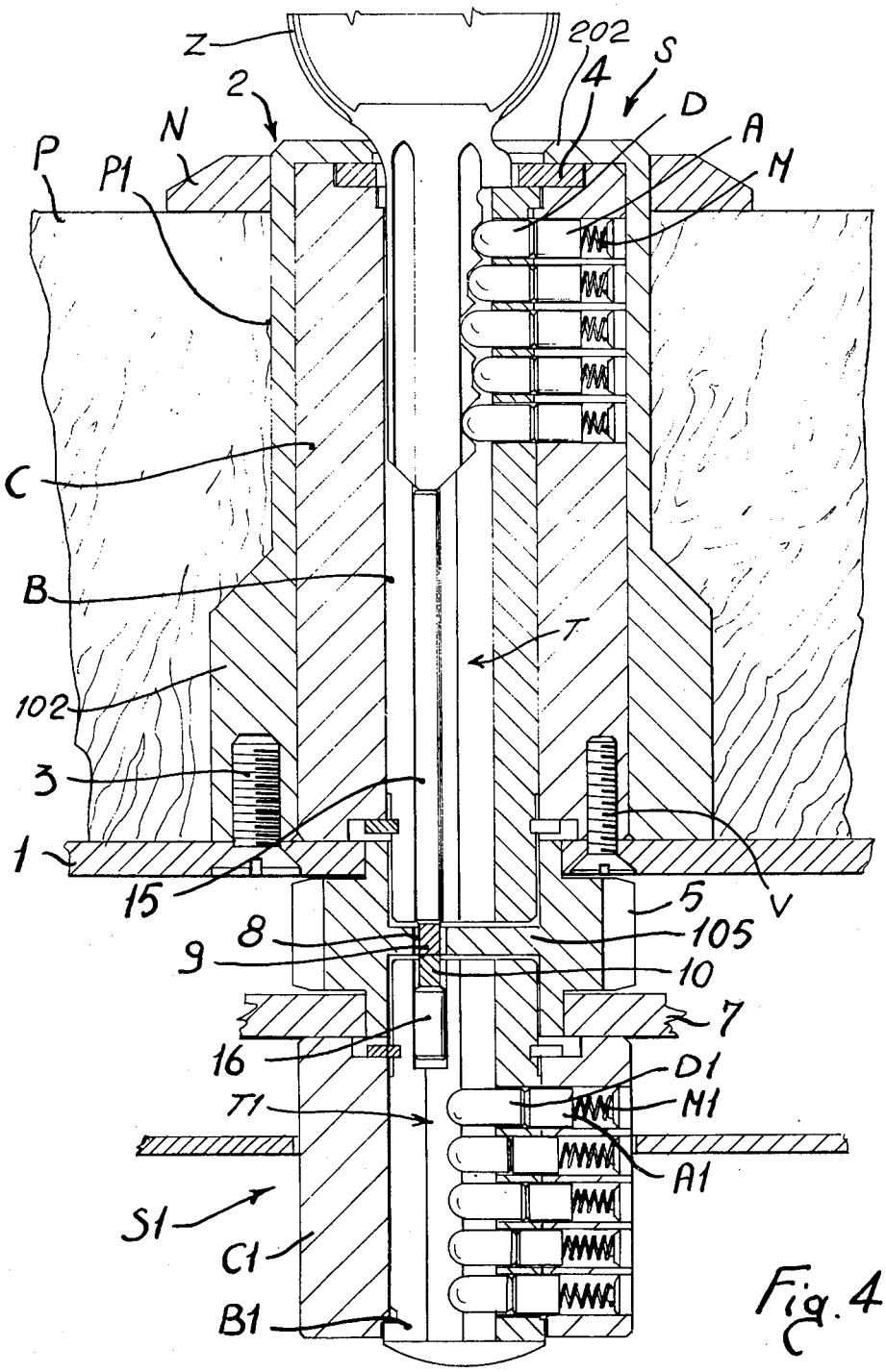
FIG. 4 is a longitudinal section, with parts in view, of a protected cylinder lock according to the invention, associated with another unprotected cylinder lock located on the inside of the door.
Figure 5:
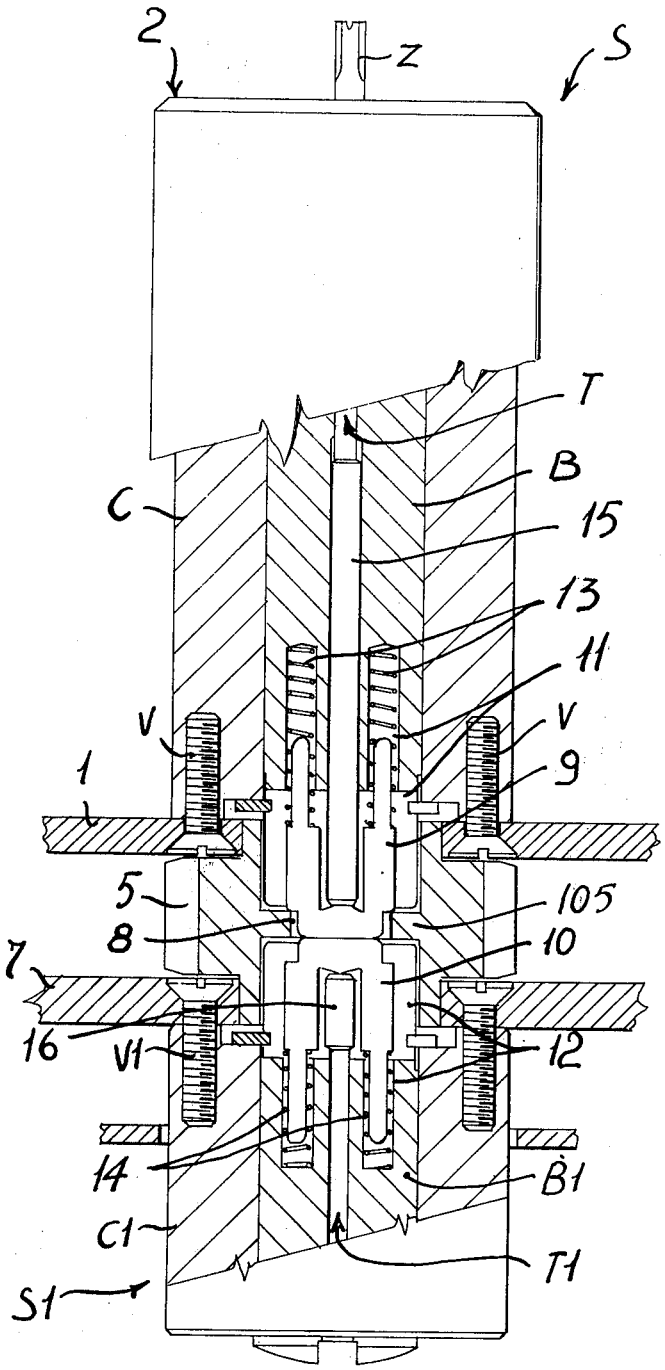
FIG. 5 is a longitudinal section, with parts in view and parts broken away, of the cylinder lock of FIG. 4, said section being rotated by 90° with respect to that of FIG. 4.

With reference to FIGS. 4 and 5, there will now be described an embodiment according to which the bolt is actuated either by the lock mechanism S from the outside, or by the lock mechanism S1 located at the inside. In this case, onto a plate 7, secured by any means (not shown) to plate 1, there is fastened, by means of the screws V1, the cylinder C1 provided with the rotatable plug B1 and the pin tumbler mechanism D1, A1, M1. Of course, the cylinder lock mechanism consisting of cylinder C1 and plug B1 is identical to the mechanism of cylinder C and plug B. The two lock mechanisms are in an opposed and axially aligned arrangement. Between the two actuating ends of plugs B, B1 there is interposed the actuating member for the door bolt, which in the present case consists of a pinion 5, presenting two axially opposed cylindrical cavities inside which there are freely rotatable the said actuating ends of plugs B and B1, which are divided by a partition 105 of said pinion 5. Said partition presents a rectangular through slot 8 which can be engaged by the suitably shaped end portions of opposed coupling elements 9 and 10 which are slidably movable in axial direction within seats 11, respectively 12, provided respectively in plugs B and B1.

Under normal conditions, when the keys are not inserted, the coupling elements 9 and 10 are urged towards each other by suitable springs 13 and 14, so each element penetrates inside slot 8 for half the length of the slot which is thus partially engaged by both key elements 9 and 10. Upon insertion of the key in either keyhole, the free end of the key will promote, either directly or through the pin-like extensions 15 or 16, the engagement of slot 8, and consequently of pinion 5, exclusively either by coupling element 9 carried by plug B or by coupling element 10 carried by plug B1, the insertion of one coupling element excluding necessarily the other. Thus the relevant plug will be rotated, actuating, through pinion 5, the door bolt.

In the embodiment just described, the cylinder lock mechanism S1 located at the interior is not, of course, protected by any steel casing.

We claim:

1. A protected cylinder lock of the type to be mounted on a frame, particularly a door, by securing it to a suitable fastening plate provided at the inner side of the door, comprising:
   a. a cylinder lock mechanism of conventional type comprising an outer cylinder and a rotatable plug, the outer cylinder being secured to the fastening plate by means of suitable fasteners;
   b. a hard material protective casing, fitted onto and encasing the said cylinder lock mechanism, said casing being constructed as a tubular member presenting an open end in correspondence with the extremity of the cylinder lock mechanism directed towards the inside of the door, and a partially closed end in correspondence with the extremity of the cylinder lock mechanism, or external appearing at the outer or external side of the door, said casing being fastened to the said fastening plate by means of suitable fasteners, and presenting a tubular cavity having a transverse section such as to permit the rotation of the outer cylinder of the cylinder lock mechanism encased therein.

2. A protected cylinder lock according to claim 1, in which both the tubular cavity of the protective casing and the outer cylinder encased thereinto present a circular section.

3. A protected cylinder lock according to claim 1, in which the partially closed end of the casing presents a circular opening the center of which coincides with the axis of the rotatable plug, said circular opening having a diameter which is approximately equal to the diameter of the rotatable plug, so as to permit the rotation of a suitable key inserted in the keyhole provided in the said rotatable plug.

4. A protected cylinder lock according to claim 3, in which in correspondence with the front extremity of the cylinder lock mechanism, between said front extremity and the inner side of the partially closed end of the casing, there is rotatably housed, in a suitable recess, a protective disc made of hard material, said disc having a diameter greater than the circular opening of the said partially closed end, and being provided with a slot for the insertion of the key into the keyhole of the rotatable plug.

5. A protected cylinder lock according to claim 1, in which the fasteners for fastening the outer cylinder and the casing are screws.

6. A protected cylinder lock according to claim 1, in which the tubular casing presents, on its outer side surface in correspondence with the open end, an enlarged portion.

7. A protected cylinder lock according to claim 6, in which the outer side surface of the casing is cylindrical and presents, in correspondence with the open end of the casing, a circumferential enlarged portion.

8. A protected cylinder lock according to claim 1, in which the fastening plate forms part of the door bolt mechanism.

9. A protected cylinder lock according to claim 1, in which the casing and the protective disc are made of steel.

* * * * *